US006375498B1

(12) United States Patent
Yu et al.

(10) Patent No.: US 6,375,498 B1
(45) Date of Patent: Apr. 23, 2002

(54) COMPACT ELECTRICAL CONNECTOR HAVING BOARDLOCKS

(75) Inventors: Weicheng Yu; GuangXing Shi; Weiya Cheng; Qiang Chen, all of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/877,557

(22) Filed: Jun. 8, 2001

(30) Foreign Application Priority Data

Dec. 21, 2000 (TW) ..... 089222252

(51) Int. Cl.[7] ..... H01R 13/648
(52) U.S. Cl. ..... 439/567; 439/607
(58) Field of Search ..... 439/567, 569, 439/607–610, 570

(56) References Cited

U.S. PATENT DOCUMENTS 5,921,811 A * 7/1999 Hsu ..... 439/607
5,947,769 A * 9/1999 Leonard et al. ..... 439/607
6,210,218 B1 * 4/2001 Chang ..... 439/567
6,241,556 B1 * 6/2001 Chih ..... 439/607

* cited by examiner

*Primary Examiner*—Hien Vu
(74) *Attorney, Agent, or Firm*—Wei Te Chung

(57) ABSTRACT

An electrical connector (100) including a housing (1), a number of terminals (2), a pair of metallic boardlcoks (4), and a conductive shield (3). The housing has a base wall (12) which defines a recess (122) at each of opposite ends thereof and a number of cutouts (123) located symmetrically in a front surface and a bottom surface thereof, and a mating wall (11). Each boardlock consists of a body (44), a head (42) projecting upwardly from the body and seated in a corresponding recess, a pair of arms (45) bilaterally projecting from the body and extending into corresponding cutouts, and a pair of feet (43). The shield has a pair of fingers (33) extending across the heads for fitting the boardlocks to the base wall and establishing a grounding path therethrough. The width of the connector is minimized to substantially as that of the mating wall.

7 Claims, 5 Drawing Sheets

COMPACT ELECTRICAL CONNECTOR HAVING BOARDLOCKS

BACKGROUND OF THE INVENTION

1. Field of the Invention

The present invention relates to an electrical connector, and particularly to an electrical connector having a minimized lateral dimension and having a pair of boardlocks reliably secured thereon.

2. Description of Related Art

As is shown in FIG. 5, a conventional connector 7 includes a dielectric housing 70, a plurality of terminals 71 secured in the housing 70, a pair of boardlocks 78 mounted on the housing 70, and a metal shield 72 attached to the housing 70.

The housing 70 has a mating wall 701 in which the terminals 71 are received and forms a pair of blocks 702 at opposite lateral ends thereof. The shield 72 surrounds the mating wall 701. Each boardlock 78 is secured in a corresponding block 702 such that a finger 781 thereof extends inwardly toward the mating wall 701 and abuts against the shield 72 for establishing an electrical path therebetween. By such design, the blocks 702 are situated in line with the mating wall 701 and thus require the housing 70 to be significantly wider than the mating wall 701. However, minimization is a trend in computer industry, which prefers compact connectors. The conventional connector can hardly satisfy the minimization requirement since it needs a pair of blocks 702 projecting outwardly beside the mating wall 701 to receive the boardlocks 78. It is thus desired to omit the blocks and provide a connector possessing a width substantially equal to that of the mating wall.

SUMMARY OF THE INVENTION

Accordingly, one object of the present invention is to provide a compact electrical connector with minimized lateral dimension.

Another object of the present invention is to provide an electrical connector having a pair of boardlocks reliably secured on lateral sides of a housing thereof without increasing width of the housing.

In order to achieve the objects set forth, an electrical connector comprises a dielectric housing, a pair of metallic boardlocks mounted to the housing, and a shield attached to the housing.

The housing includes a base wall, a mating wall projecting forwardly from the base wall for mating with a complementary connector, and a pair of platforms. The base wall defines a U-shaped recess in each lateral side thereof and forms a rib in the recess. Two sets of cutouts are located between the mating wall and the platforms. One set of dovetail cutouts is defined in a front surface and a bottom surface of the base wall and opens to each outer surface of the base wall.

Each boardlock has a fork-shaped head, a body, a pair of arms extending from the body, and a pair of feet depending from the body for catching a printed circuit board on which the connector is mounted.

The boardlocks are fixed to the housing such that the heads are seated in corresponding recesses of the base wall and the arms are accommodated in corresponding cutouts of the base wall. The ribs and the arms cooperate to position the boardlocks on the housing.

In addition, the shield provides a pair of rearwardly extending fingers which extend across the heads and gripping against the bottom surface of the base wall for securing the boardlocks on the housing and electrically connecting with the boardlocks.

It is a feature of the present invention that the heads seated in the recesses are flush with the outer surfaces of the base wall and the fingers of the shield extending across the heads are flush with the feet extending over the outer surfaces of the base wall. The width of connector is thus minimized as to substantially equal to the width of the mating wall, which is about the width of the mating wall.

Other objects, advantages and novel features of the invention will become more apparent from the following detailed description when taken in conjunction with the accompanying drawings.

DETAILED DESCRIPTION OF THE INVENTION

Figure 1:
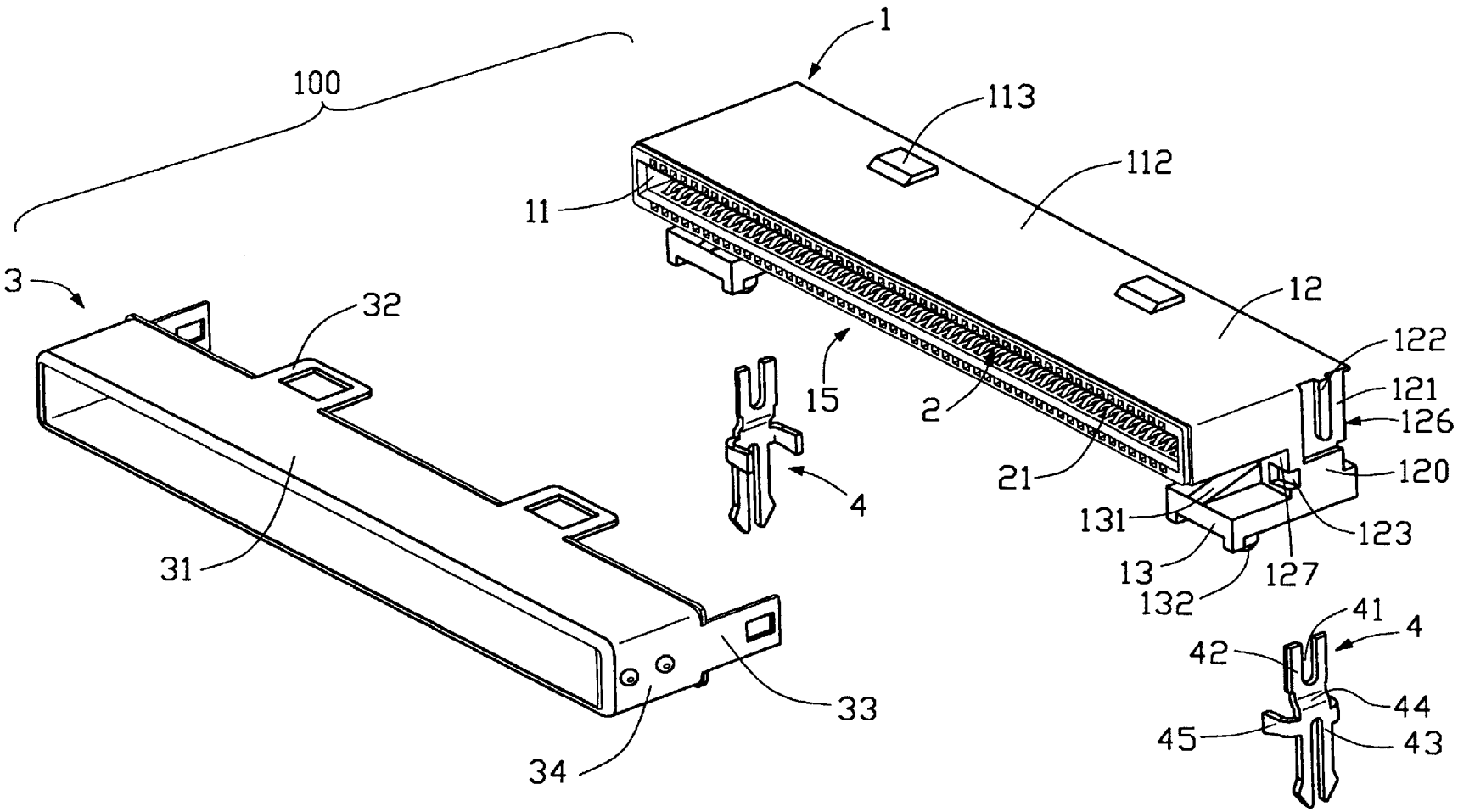
FIG. 1 is a partially exploded view of an electrical connector in accordance with the present invention.

Referring to FIG. 1, an electrical connector 100 of the present invention comprises an insulative housing 1, a plurality of metal terminals 2 received in the insulative housing 1, a pair of metal boardlocks 4, and a conductive shield 3 for binding the insulative housing 1 and the boardlocks 4 together.

The insulative housing 1 includes a longitudinal base wall 12, a mating wall 11 projecting forwardly from an upper portion of the base wall 12, and a pair of platforms 13 extending forwardly from a lower portion of the base wall 12. The mating wall 11 and the base wall 12 are of same width. The feet 13 are vertically spaced from the mating wall 12, defining a space 15 therebetween in front of the base wall 12.

The base wall 12 defines a pair of U-shaped recesses 121 in opposite ends thereof, wherein a pair of ribs 122 is formed, and a pair of sets of dovetailed cutouts 123 in opposite ends thereof. The ribs 122 are of a same thickness as that of the boardlocks 4 and the recesses 121 have a depth equal to the thickness of the boardlocks 4. The cutouts 123 extend inwardly from outer surfaces 120 of the base wall 12 below the recesses 121. Each set of the cutouts 123 is located in a rear surface 126 and a front surface 127 of the base wall 12 and interposed between the mating wall 11 and a corresponding platform 13. Moreover, the base wall 12 forms a pair of protrusions 113 on a top surface 112 thereof for locking the shield 3 on the housing 1.

The mating wall 11 is box-like and defines an engaging opening 11 extending rearwardly from a front surface thereof and within which engaging sections 21 of the terminals 2 protrude for mating with corresponding engaging portions of a complementary connector (not shown).

Each platform 13 forms an reinforcing block 131 in the space 15 on a top surface thereof. The reinforcing blocks 131 are respectively connected to the front surface 127 of the base wall 12 at portions inward from corresponding cutouts 123. The platforms 13 each provide a post 132 on a bottom surface thereof for positioning the connector 100 relative to a printed circuit board (not shown) on which the connector 100 is mounted.

Each boardlock 4 has a bifurcated head 42 defining an upwardly facing channel 41, a body 44, a pair of arms 45 symmetrically and perpendicularly extending from lateral sides of the body 44, and a pair of feet 43 depending from the body 44 for resiliently catching the printed circuit board (not shown) on which the connector 100 is mounted. The body 44 is step-shaped such that the head 42 and the feet 43 are parallel to each other. The arms 45 are perpendicular to the head 42 and join with the body 44 at portions planar with the feet 43. Each arm 45 is dovetail-shaped for engaging with corresponding cutouts 123 of the base wall 12.

The shield includes a shroud 31, a pair of locking members 32 projecting rearwardly from a top edge of the shroud 31, and a pair of finger 33 extending rearwardly from lateral edges 34 of the shroud 31.

Figure 2:
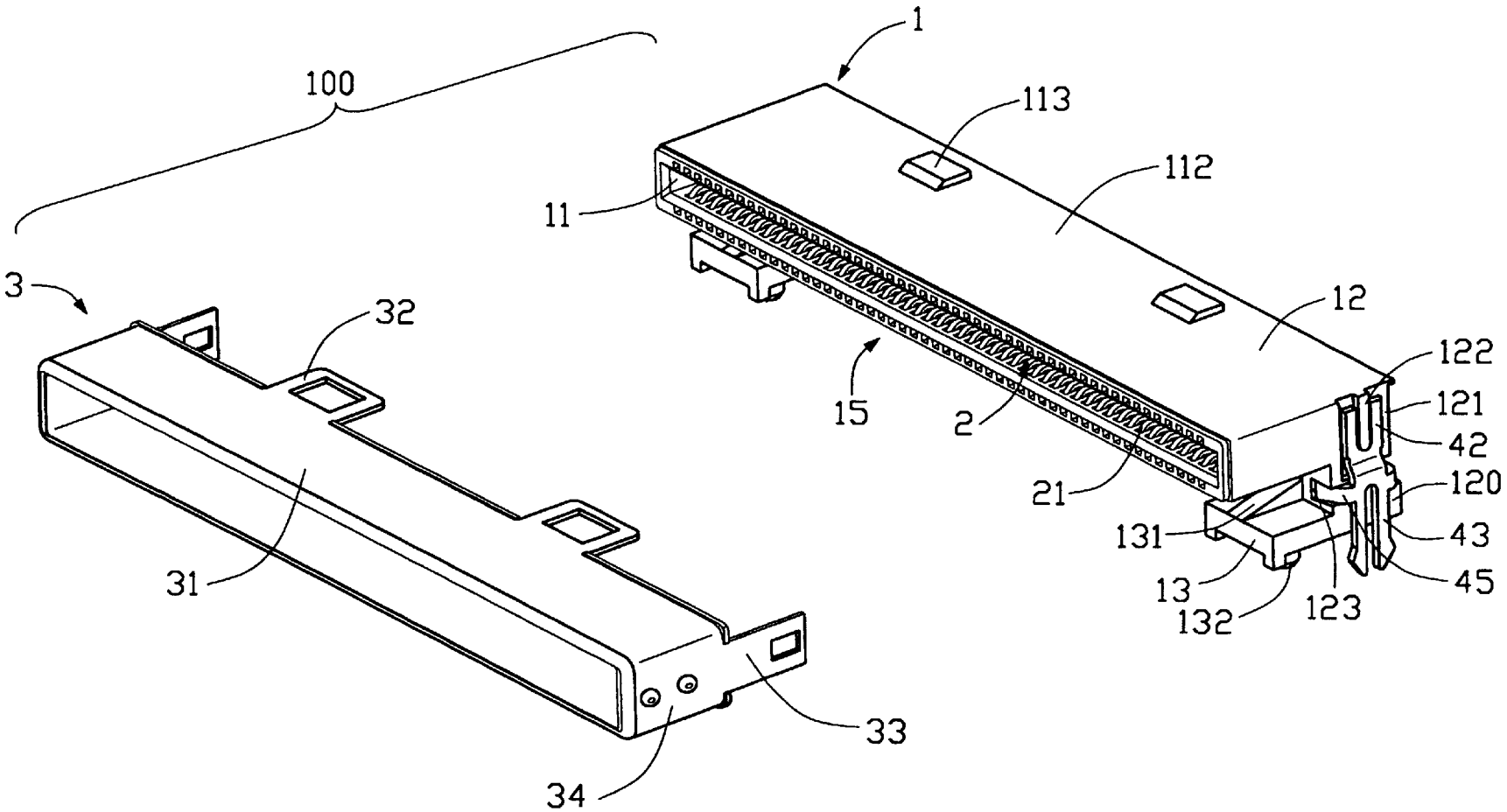
FIG. 2 is a partially assembled view of the electrical connector of FIG. 1, showing boardlocks secured to a housing of the electrical connector of FIG. 1.

In assembly, as is shown in FIG. 2, the boardlocks 4 are firstly attached to the housing 1 in a way that heads 42 are seated in the recesses 121 of the base wall 12, the feet 43 extend over the outer surface 120, and the arms 45 are bent into corresponding cutouts 123 of the base wall 12. The head 42 is then flush with the outer surface 120. Upward and lateral movements of each boardlock 4 are prevented by a corresponding rib 122 which is snuggly fitted into the channels 41 of the heads 42. The pair of arms 45 received in the cutouts 123 avoids the boardlocks 4 from moving in forward and rearward directions. In addition, the dovetail-shaped arms 45 serve to prevent the boardlocks 4 from dropping outwardly from the base wall 12 of the housing 1.

Figure 3:
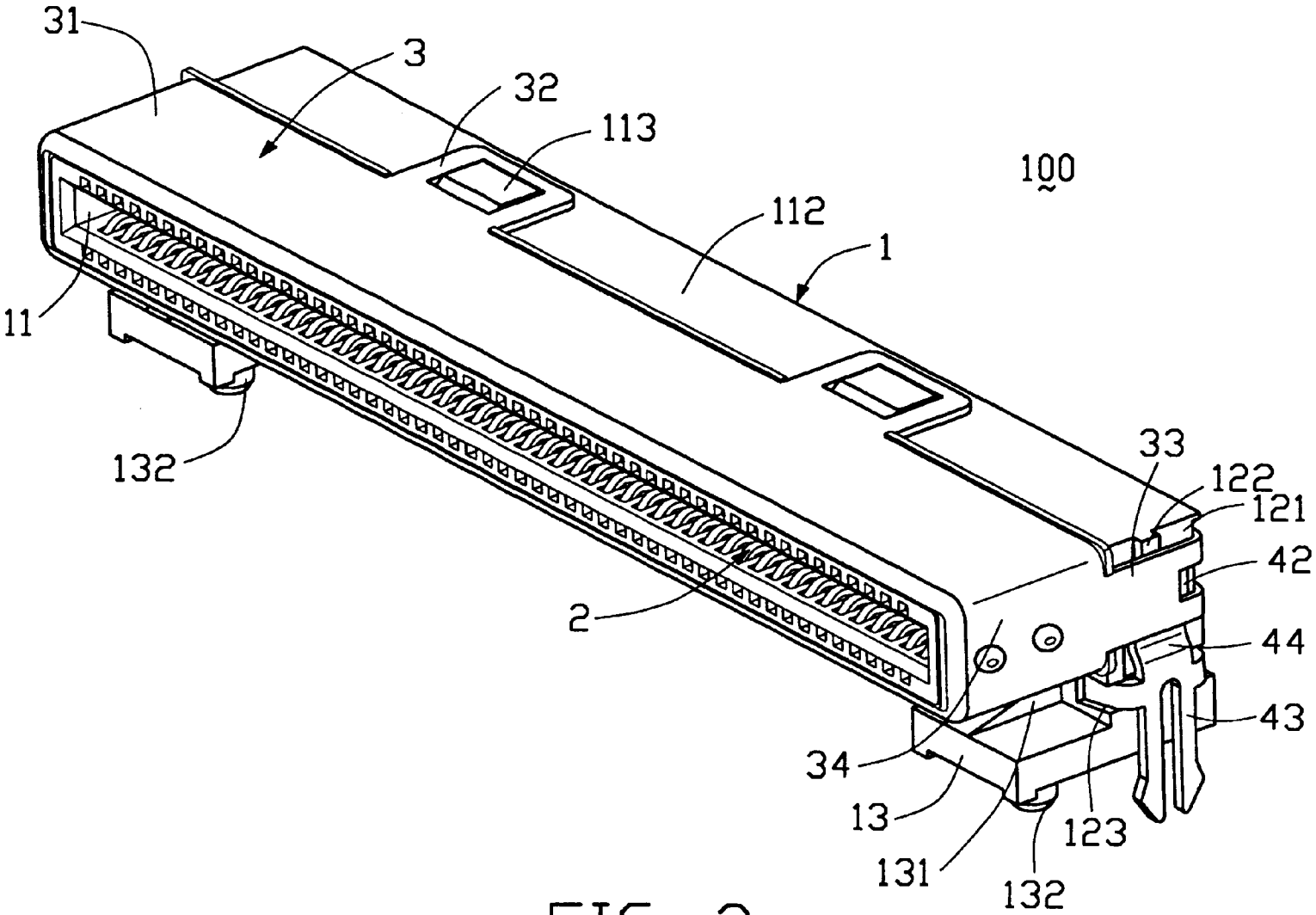
FIG. 3 is an assembled view of the electrical connector of FIG. 2.
Figure 4:
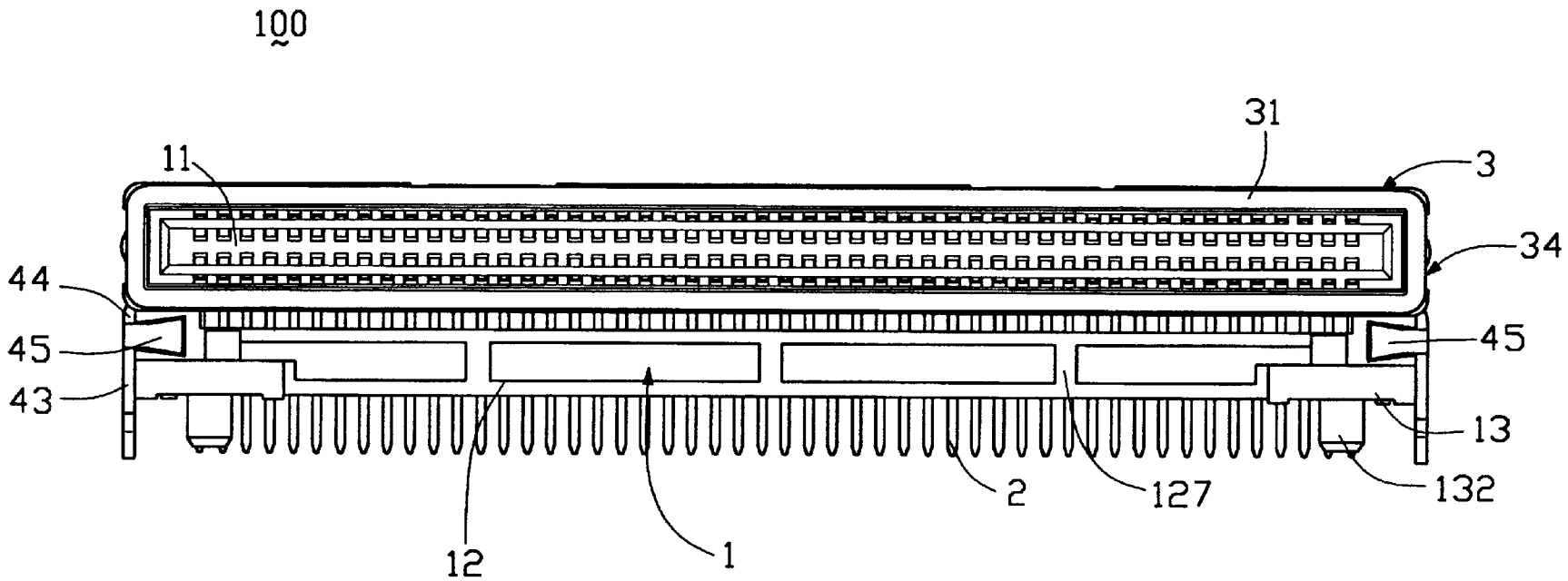
FIG. 4 is a front view of the electrical connector of FIG. 3.
Figure 5:
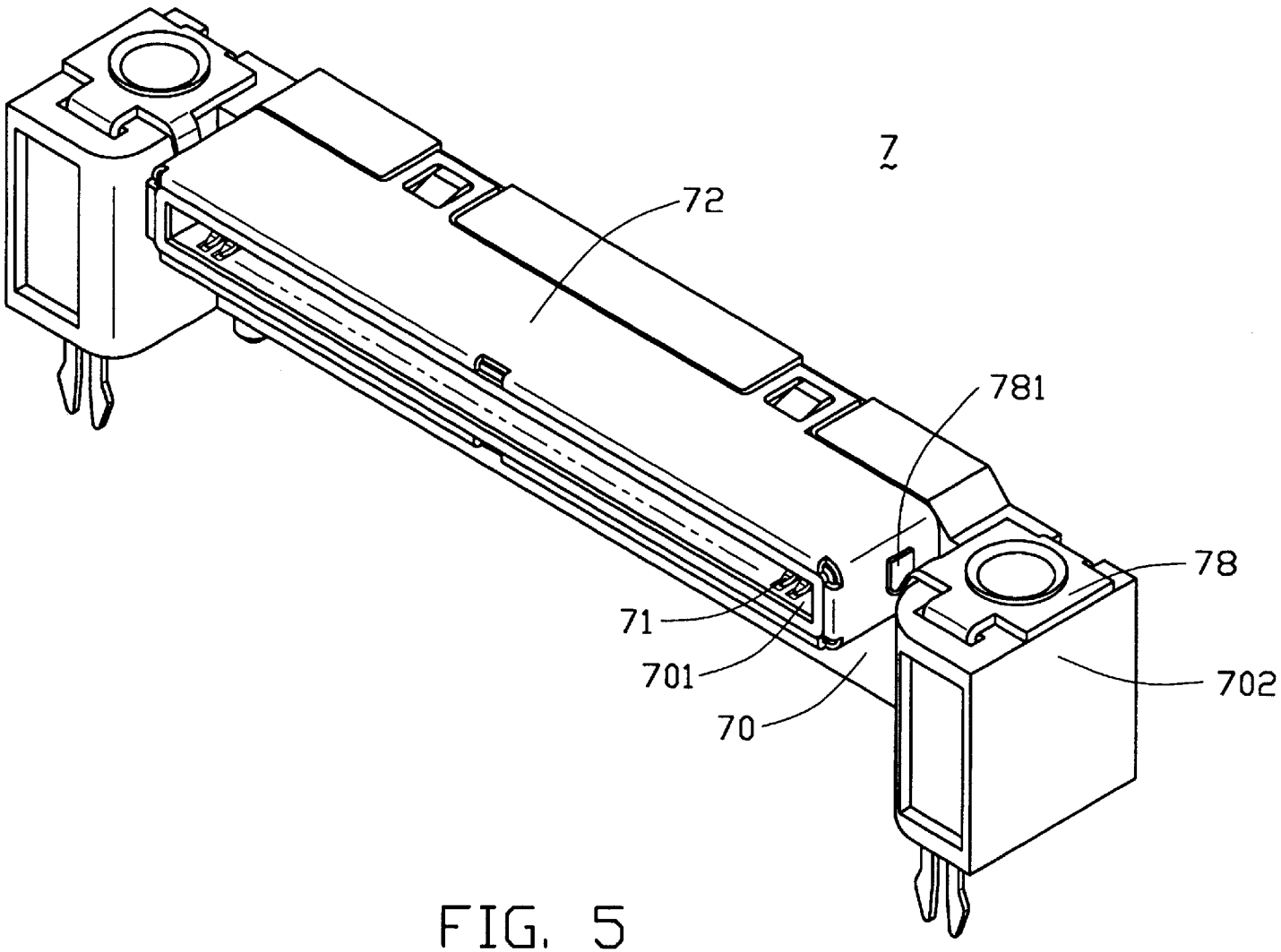
FIG. 5 (PRIOR ART)
FIG. 5 is a perspective view of a conventional connector.

Secondly, the shield 3 is assembled to the housing 1 as is best shown in FIGS. 3 and 4. The shroud 31 surrounds the mating wall 11. The locking members 32 are stopped by the protrusions 113 and the fingers 33 extend rearwardly beyond the base wall 12 and are finally curved to the rear surface 126 of the base wall 12, the locking members 32 and the fingers 33 together attaching the shield 3 to the housing 1. The fingers 33 extend across the heads 42 and press the heads 42 against the base wall 12, thereby securing the boardlocks 4 on the housing 1. Since the heads 42 are flush with the outer surfaces 120 on which the feet 43 abut and the thickness of the fingers 33 is substantially equal to that of the feet 43, lateral edges 34 of the shield 3 are substantially planar with the feet 43 of the boardlocks 4. Therefore, the width of the connector 100 is minimized to substantially equal to the sum of the width of the mating opening 11, the thickness of a sidewall of the mating wall 11, and the thickness of the shield 3. In other words, the width of the connector 100 is substantially the width of the shroud 31 of the shield 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mounting on a printed circuit board, comprising:

an insulative housing including a base wall and a mating wall projecting forwardly from the base wall for mating with a complementary connector, the base wall defoaming a recess and an outer surface in a lateral side thereof;

a plurality of terminals mounted in the mating wall for engaging with corresponding contacts of the complementary connector;

a metallic boardlock attached to the base wall of the housing, the boardlock having a head seated in the recess and a tail member depending beyond the base wall; and a metallic shield having a shroud surrounding the mating wall and a finger abutting the head of the boardlock against the lateral side of the base wall and fastening to the base wall of the housing; wherein the head has one side abutting against the base wall and an opposite side flush with the outer surface of the base wall; wherein the finger is substantially coplanar with the tail member of the boardlock; wherein the base wall forms a rib in the recess, and wherein the head of the boardlock defines a channel receiving the rib of the base wall for preventing the boardlock from moving upwardly and laterally relative to base wall of the housing; wherein the base wall further defines a pair of cutouts in the lateral side thereof, and wherein the boardlock forms a pair of arms fitted in the cutouts for positioning the boardlock relative to the housing; wherein the pair of cutouts are respectively defined in a front surface and a rear surface of the lateral side of the base wall and the arms fitted in the cutouts prevent the boardlock from moving forwardly and rearwardly; wherein the arms extend perpendicularly relative to the head.

2. The electrical connector as described in claim 1, wherein the cutouts are located below the mating wall.

3. The electrical connector as described in claim 2, further comprising a pair of platforms under the mating wall, each platform forming a reinforcing block connected with the base wall.

4. The electrical connector as described in claim 3, wherein the cutouts are defined above the platform and outwardly of the reinforcing blocks.

5. The electrical connector as described in claim 4, wherein the base wall forms a pair of protrusions on a top surface thereof, and wherein the shroud of the shield forms a pair of locking members at an upper edge thereof, the locking members extending rearwardly and latching to the protrusions.

6. The electrical connector as described in claim 5, wherein the tail member of the boardlock is adapted to resiliently extend hto the printed circuit board for grounding.

7. The electrical connector as described in claim 6, wherein the tail member comprises a pair of feet.

* * * * *